US009554201B2

(12) United States Patent
Williams et al.

(10) Patent No.: US 9,554,201 B2
(45) Date of Patent: Jan. 24, 2017

(54) MULTIPLE-ORIENTATION AUDIO DEVICE AND RELATED APPARATUS

(71) Applicant: Bose Corporation, Framingham, MA (US)

(72) Inventors: Chester Smith Williams, Lexington, MA (US); Roman N. Litovsky, Newton, MA (US); Bojan Rip, Newton, MA (US); Benjamin D. Burge, Shaker Heights, OH (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 14/672,970

(22) Filed: Mar. 30, 2015

(65) Prior Publication Data

US 2015/0281866 A1 Oct. 1, 2015

Related U.S. Application Data

(60) Provisional application No. 61/972,694, filed on Mar. 31, 2014.

(51) Int. Cl.
*H04R 1/02* (2006.01)

(52) U.S. Cl.
CPC ..... *H04R 1/026* (2013.01); *H04R 2201/025* (2013.01); *H04R 2420/03* (2013.01)

(58) Field of Classification Search
CPC ..... H04R 2201/025; H04R 1/02; H04R 1/026; H04R 29/001; H04R 2420/03
See application file for complete search history.

(56) References Cited

U.S. PATENT DOCUMENTS

2006/0039574 A1* 2/2006 Chen ..... H04R 1/1058 381/151
2007/0265031 A1* 11/2007 Koizumi ..... H04M 1/0225 455/556.1
2013/0022221 A1* 1/2013 Kallai ..... H04R 3/12 381/300
2013/0028446 A1* 1/2013 Krzyzanowski ..... H04R 5/04 381/109
2013/0101124 A1* 4/2013 Faure ..... H04R 29/00 381/56
2014/0079276 A1* 3/2014 Szymanski ..... H04R 1/02 381/386
2014/0193017 A1* 7/2014 Fortin ..... H04R 1/021 381/334

* cited by examiner

*Primary Examiner* — Mark Fischer

(57) ABSTRACT

An audio device includes a housing having first and second support surfaces for supporting the device at different orientations relative to the surface on which the device is placed, a driver to output sound in a radiating pattern associated with a first axis of the driver, and an orientation sensor to detect a direction of a force of gravity. A control circuit coupled to the driver and the orientation sensor determines the direction of the force of gravity relative to the first axis and whether the first axis is oriented to one of a first angle of elevation associated with physically supporting the device by the first surface and a second angle of elevation associated with physically supporting the device by the second surface. The circuit can alters the output by the driver based on the first axis being oriented to the first or second angles of elevation.

16 Claims, 8 Drawing Sheets

1000

1000

MULTIPLE-ORIENTATION AUDIO DEVICE AND RELATED APPARATUS

RELATED APPLICATION

This application claims benefit from U.S. Provisional Patent Application No. 61/972,694, filed Mar. 31, 2014 and titled "Audio Speaker," the entire contents of which are incorporated herein by reference.

TECHNICAL FIELD

Various embodiments pertain to audio speakers able to detect an orientation relative to a direction of a force of gravity and to adjust their acoustic output based on the orientation.

BACKGROUND

Portable audio speakers have become very popular due to their ease of use and high quality of sound. Users will often take such audio speakers with them to different locations and place them atop any of a variety of objects or physically support them in any of a variety of other ways. Unfortunately, some of these possible placements of audio speakers can be less than ideal with regard to the resulting quality of the experience of listening to their acoustic output. Some possible placements can result in distortion of various ranges of frequencies of sound as perceived by a listener and/or defeat the intended effect of stereo and/or surround sound. Improved sound quality coupled with increased flexibility in the use and placement portable speakers is desired by users of these audio technologies.

SUMMARY

The invention is directed to an audio device for placement on a surface, comprising: a housing incorporating a first support surface and a second support surface by which the audio device may be physically supported. The first and second support surfaces providing the audio device with different orientations relative to the surface on which the audio device is placed. There is a first acoustic driver incorporated into the housing to acoustically output sound in a radiating pattern associated with a first axis of the first acoustic driver and an orientation sensor incorporated into the housing to detect a direction of a force of gravity. There is a control circuit coupled to the first acoustic driver and the orientation sensor which operates the orientation sensor to determine the direction of the force of gravity relative to the first axis. The control circuit also determines whether the first axis is oriented to one of a first angle of elevation associated with physically supporting the audio device by the first support surface and a second angle of elevation associated with physically supporting the audio device by the second support surface; wherein the first and second angles of elevation are different and non-zero relative to the surface on which the device is placed. The control circuit further alters a characteristic of acoustic output of sound by the first acoustic driver based on the first axis being oriented to one of the first and second angles of elevation.

The housing includes a side that comprises the first and second support surfaces, the first and second support surfaces meeting at an angle and having a generally elongate shape associated with a longitudinal axis extending lengthwise along the elongate shape. The housing, when transitioning from physically supporting the audio device by the first support surface to physically supporting the audio device by the second support surface, entails rotating the housing about the longitudinal axis. The weights of the first acoustic driver and at least one other component of the audio device are distributed to enable stability in physically supporting the audio device by either the first or second support surfaces. The housing comprising a first side that comprises the first support surface and a second side opposite the first side, the second side comprising the second support surface, and the first and second surfaces having asymmetric orientations such that the first and second sides are of asymmetric configuration.

The housing has a generally elongate shape defining a first end comprising a third support surface and a second end comprising a fourth support surface, the third and fourth support surfaces having different orientations. The first and second sides extend lengthwise along the elongate shape and the control circuit determines whether the first axis is oriented to one of the first angle of elevation, the second angle of elevation, a third angle of elevation associated with physically supporting the audio device by the third support surface and a fourth angle of elevation associated with physically supporting the audio device by the fourth support surface. The control circuit alters the characteristic of the acoustic output based on whether the first axis is oriented to one of the first, second, third and fourth angles of elevation.

The audio device comprising a second acoustic driver incorporated into the housing to acoustically output sound in a radiating pattern associated with a second axis of the second acoustic driver, wherein the first and second axes extend within a plane. The control circuit determines an orientation of the plane relative to the direction of the force of gravity and allocates one of a first audio channel and a second audio channel to the first acoustic driver and allocates another of the first and second audio channels to the second acoustic driver in response to the plane being oriented more horizontally than vertically with respect to the direction of the force of gravity. The control circuit allocates a mixture of the first and second audio channels to at least one of the first and second acoustic drivers in response to the plane being oriented more vertically than horizontally with respect to the direction of the force of gravity.

The housing having a generally elongate shape defining a first end at which the first acoustic driver is disposed and a second end at which the second acoustic driver is disposed, wherein the plane being oriented more horizontally than vertically is associated with the housing being rotated to a landscape orientation and the plane being oriented more vertically than horizontally is associated with the housing being rotated to a portrait orientation. The control circuit determines which of the first and second audio channels to allocate to the first acoustic driver and which of the first and second audio channels to allocate to the second acoustic driver based on the direction of the force of gravity relative to the plane when the plane is oriented more horizontally than vertically.

The invention includes an interface coupled to the control circuit to receive via a communications link a signal representing sound to acoustically output via at least the first acoustic driver. The is a manually operable control coupled to the control circuit, the control circuit to monitor the control for an indication of manual operation to convey a command to alter acoustic output of sound by at least the first acoustic driver, and to operate the interface to convey the command to a source device from which the signal representing sound is received via the communications link.

The housing comprises and is separable into a first housing portion and a second housing portion; the first housing portion comprises the first acoustic driver, the orientation sensor and the control circuit. The second housing portion comprises a power source, and the first and second support surfaces. The control circuit comprises a filter block that employs at least one digital filter to alter the characteristic. The second housing portion comprises a storage element that stores indications of a first digital filter configuration associated with the first support surface and a second digital filter configuration associated with the second support surface and the control circuit configures the at least one digital filter with the first or second filter configuration based on the first axis being oriented to one of the first and second angles of elevation.

The invention further includes a method comprising receiving a signal representing at least a first audio channel of a sound via a communications link and driving a first acoustic driver of an audio device located on a surface to acoustically output sound in a radiating pattern associated with a first axis of the first acoustic driver. The method also includes detecting a direction of a force of gravity and determining whether the first axis is oriented to one of a first angle of elevation associated with physically supporting a housing of the audio device incorporating the first acoustic driver by a first support surface thereof and a second angle of elevation associated with physically supporting the housing by a second support surface thereof. The first and second support surfaces have different orientations and wherein the first angle of elevation and the second angle of elevation are different and non-zero relative to the surface on which the audio device is located. The method further includes altering a characteristic of acoustic output of the sound by the first acoustic driver based on the first axis being oriented to one of the first and second angles of elevation.

The invention includes retrieving from a storage one of a first digital filter configuration and a second digital filter configuration based on the first axis being oriented to one of the first and second angles of elevation and configuring at least one digital filter to alter the characteristic based on the retrieved one of the first and second digital filter configurations. There is also included determining whether the first axis is oriented to one of the first angle of elevation, the second angle of elevation, a third angle of elevation associated with physically supporting the housing by a third support surface thereof and a fourth angle of elevation associated with physically supporting the housing by a fourth support surface thereof. The housing has a generally elongate shape defining at least one elongate side comprising at least one of the first and second supporting surfaces, defining a first end comprising the third support surface, and defining a second end comprising the fourth support surface. The third and fourth support surfaces have different orientations. There is also included the step of altering the characteristic of the acoustic output based on whether the first axis is oriented to one of the first, second, third and fourth angles of elevation.

The method also includes determining an orientation of a plane in which both the first axis and a second axis extend relative to the direction of the force of gravity, the second axis associated with a radiating pattern of a second acoustic driver incorporated into the housing and allocating one of the first audio channel and a second audio channel of the sound to the first acoustic driver and allocating the other of the first and second audio channels to the second acoustic driver in response to the plane being oriented more horizontally than vertically with respect to the direction of the force of gravity. Further, the method includes allocating a mixture of the first and second audio channels to at least one of the first and second acoustic drivers in response to the plane being oriented more vertically than horizontally with respect to the direction of the force of gravity. Also included is the step of determining which of the first and second audio channels to allocate to the first acoustic driver and which of the first and second audio channels to allocate to the second acoustic driver based on the direction of the force of gravity relative to the plane when the plane is oriented more horizontally than vertically relative to the direction of the force of gravity.

The method includes monitoring a manually operable control incorporated into the housing for an indication of manual operation to convey a command to alter acoustic output of sound by at least the first acoustic driver and transmitting the command to a source device from which the signal is received via the communications link.

The invention is further directed to at least one machine-readable storage medium comprising instructions that when executed by a processor component, cause the processor component to receive a signal representing at least a first audio channel of a sound via a communications link and drive a first acoustic driver of an audio device located on a surface to acoustically output sound in a radiating pattern associated with a first axis of the first acoustic driver. The instructions further cause the processor to detect a direction of a force of gravity and determine whether the first axis is oriented to one of a first angle of elevation associated with physically supporting a housing of the audio device incorporating the first acoustic driver by a first support surface thereof and a second angle of elevation associated with physically supporting the housing by a second support surface thereof. The first and second support surfaces have different orientations; and wherein the first angle of elevation and the second angle of elevation are different and non-zero relative to the surface on which the audio device is located. The instructions further cause the processor to alter a characteristic of acoustic output of the sound by the first acoustic driver based on the first axis being oriented to one of the first and second angles of elevation.

The processor component is further caused to retrieve from a storage one of a first digital filter configuration and a second digital filter configuration based on the first axis being oriented to one of the first and second angles of elevation and to configure at least one digital filter to alter the characteristic based on the retrieved one of the first and second digital filter configurations. The processor component also caused to determine whether the first axis is oriented to one of the first angle of elevation, the second angle of elevation, a third angle of elevation associated with physically supporting the housing by a third support surface thereof and a fourth angle of elevation associated with physically supporting the housing by a fourth support surface thereof. The housing has a generally elongate shape defining at least one elongate side comprising at least one of the first and second supporting surfaces, defining a first end comprising the third support surface, and defining a second end comprising the fourth support surface. The third and fourth support surfaces have different orientations. The processor is further caused to alter the characteristic of the acoustic output based on whether the first axis is oriented to one of the first, second, third and fourth angles of elevation.

The processor component is also caused to determine an orientation of a plane in which both the first axis and a second axis extend relative to the direction of the force of gravity, the second axis associated with a radiating pattern of a second acoustic driver incorporated into the housing and to allocate one of the first audio channel and a second audio channel of the sound to the first acoustic driver and allocating the other of the first and second audio channels to the second acoustic driver in response to the plane being oriented more horizontally than vertically with respect to the direction of the force of gravity. The processor is further caused to allocate a mixture of the first and second audio channels to at least one of the first and second acoustic drivers in response to the plane being oriented more vertically than horizontally with respect to the direction of the force of gravity.

The processor component is caused to determine which of the first and second audio channels to allocate to the first acoustic driver and which of the first and second audio channels to allocate to the second acoustic driver based on the direction of the force of gravity relative to the plane when the plane is oriented more horizontally than vertically relative to the direction of the force of gravity. Moreover, the processor component is caused to monitor a manually operable control incorporated into the housing for an indication of manual operation to convey a command to alter acoustic output of sound by at least the first acoustic driver and transmit the command to a source device from which the signal is received via the communications link.

The invention additional includes an apparatus comprising a processor component and a driver circuit coupled to the processor component to drive a first acoustic driver of an audio device located on a surface to acoustically output sound in a radiating pattern associated with a first axis of the first acoustic driver. There is an orientation component for execution by the processor component to monitor an orientation detector to detect a direction of a force of gravity, and determine whether the first axis is oriented to one of a first angle of elevation associated with physically supporting a housing of the audio device incorporating the first acoustic driver by a first support surface thereof and a second angle of elevation associated with physically supporting the housing by a second support surface thereof, wherein the first and second support surfaces have different orientations. The first angle of elevation and the second angle of elevation are different and non-zero relative to the surface on which the audio device is located. There is also a filter block to alter a characteristic of acoustic output of the sound by the first acoustic driver based on the first axis being oriented to one of the first and second angles of elevation.

The orientation component to retrieve from a storage one of a first digital filter configuration and a second digital filter configuration based on the first axis being oriented to one of the first and second angles of elevation, and to configure at least one digital filter of the filter block to alter the characteristic based on the retrieved one of the first and second digital filter configurations. The housing comprises and is separable into a first housing portion and a second housing portion and the first housing portion comprises the first acoustic driver and the processor component. The second housing portion comprises the storage and the first and second support surfaces, the orientation component to retrieve one of the first and second digital filter configurations through a connector coupling the first and second housing portions. The orientation component determines whether the first axis is oriented to one of the first angle of elevation, the second angle of elevation, a third angle of elevation associated with physically supporting the housing by a third support surface thereof and a fourth angle of elevation associated with physically supporting the housing by a fourth support surface thereof. The housing has a generally elongate shape defining at least one elongate side comprising at least one of the first and second supporting surfaces, defining a first end comprising the third support surface, and defining a second end comprising the fourth support surface and the third and fourth support surfaces have different orientations. The filter block alters the characteristic of the acoustic output based on whether the first axis is oriented to one of the first, second, third and fourth angles of elevation.

The orientation component determines an orientation of a plane in which both the first axis and a second axis extend relative to the direction of the force of gravity, the second axis associated with a radiating pattern of a second acoustic driver incorporated into the housing. There is a channel component to allocate one of the first audio channel and a second audio channel of the sound to the first acoustic driver and allocate the other of the first and second audio channels to the second acoustic driver in response to the plane being oriented more horizontally than vertically with respect to the direction of the force of gravity, and to allocate a mixture of the first and second audio channels to at least one of the first and second acoustic drivers in response to the plane being oriented more vertically than horizontally with respect to the direction of the force of gravity.

The orientation component determines which of the first and second audio channels to allocate to the first acoustic driver and which of the first and second audio channels to allocate to the second acoustic driver based on the direction of the force of gravity relative to the plane when the plane is oriented more horizontally than vertically relative to the direction of the force of gravity. There is an interface to couple the processor component to a communications link; and a communications component for execution by the processor component to operate the interface to receive via the communications link a signal representing sound to acoustically output via at least the first acoustic driver. Further, there is a user interface (UI) component for execution by the processor component to monitor a manually operable control incorporated into the housing for an indication of manual operation to convey a command to alter acoustic output of sound by at least the first acoustic driver. The communications component operates the interface to transmit the command to a source device from which the signal is received via the communications link.

The invention is additionally directed to an audio speaker comprising a housing having a plurality of stable configurations when placed on a substantially horizontal surface and a plurality of acoustic drivers disposed within the housing and directed toward a first face of the housing, the first face having a length dimension. There is an orientation sensor disposed within and fixed to the housing to generate a signal indicative of the orientation of the first face of the housing relative to the horizontal surface and an audio processor disposed within and fixed to the housing to process received audio signals on the basis of the orientation signal and output processed audio signals to each of the plurality of acoustic drivers. When the housing is placed on the surface with one of the length dimension of the first face being substantially parallel with the surface in a horizontal position and with the length dimension being transverse to the surface in a vertical position and wherein in one of the horizontal position and the vertical position there are at least two stable configurations with the first face of the housing oriented at different, non-perpendicular angles with respect to the horizontal surface.

When the housing is placed on the surface in the horizontal position there are two stable configurations with the first face of the housing oriented at different, non-perpendicular angles with respect to the horizontal surface and a third stable configuration with the first face of the housing oriented at a substantially perpendicular angle with respect to the horizontal surface. When the housing is placed on the surface in the vertical position there is one stable configuration with the first face of the housing oriented at a non-perpendicular angle with respect to the horizontal surface and another stable configuration with the first face of the housing oriented at a substantially perpendicular angle with respect to the horizontal surface.

The housing includes a first housing portion and a second housing portion and the first and second housing portions are integrally affixed to each other or they may be removeably affixed to each other. The acoustic drivers are located in the first housing portion and the second housing portion has a mass sufficient to counteract the weight of the acoustic drivers and enable the housing to remain positioned in said plurality of stable configurations.

DETAILED DESCRIPTION

Figure 1:
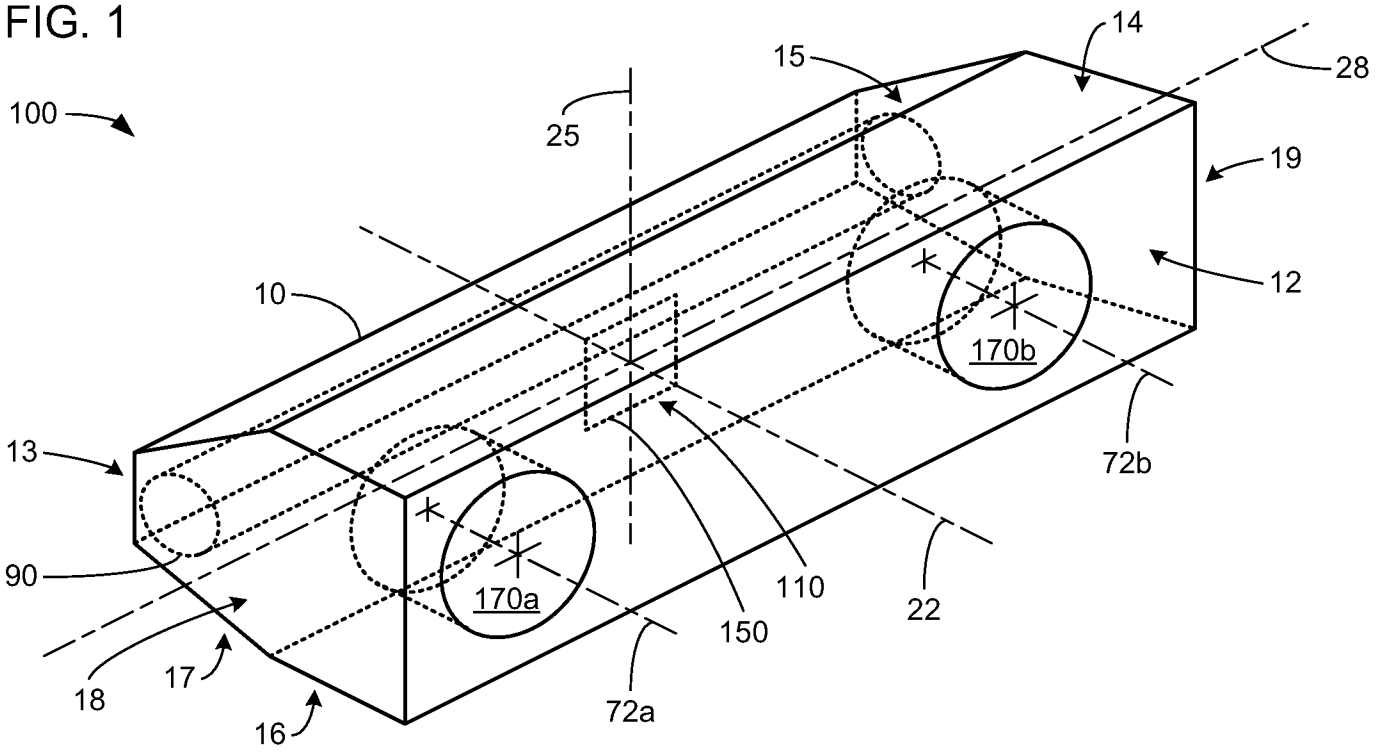
FIGS. 1 and 2 are perspective views of an embodiment of an audio device.
Figure 2:
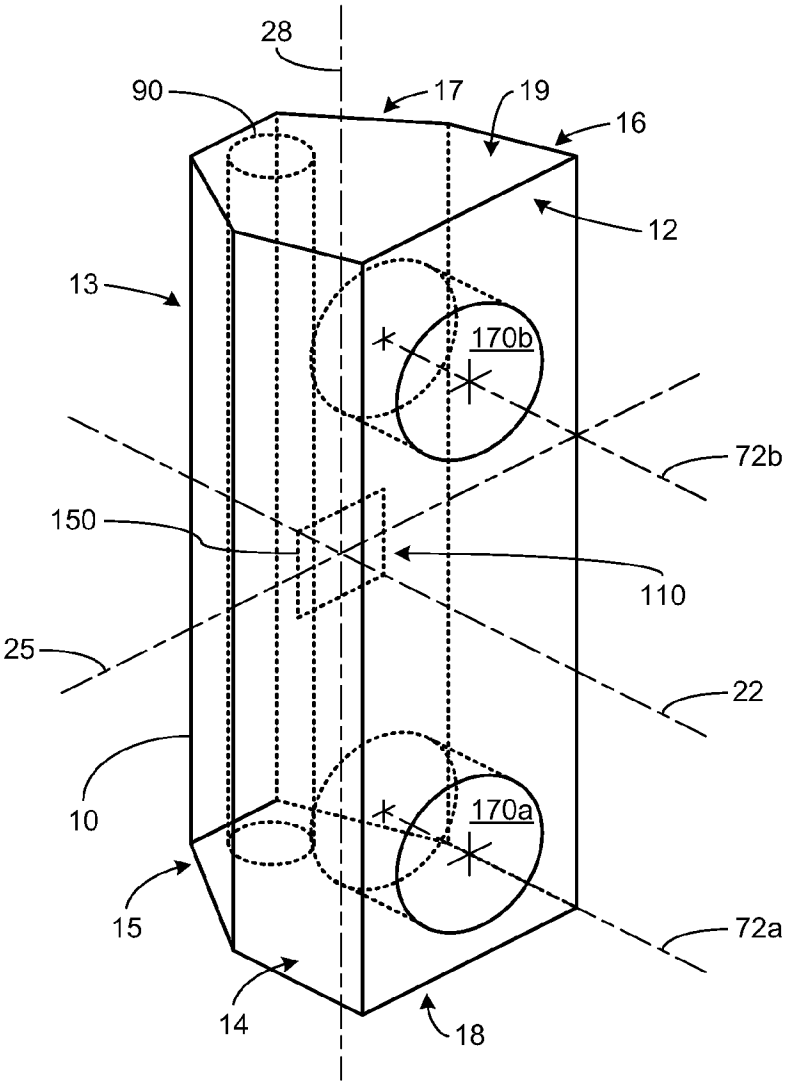

FIGS. 1 and 2 are perspective views of an embodiment of an audio device 100 to acoustically output sound, such as music, speech, etc. The audio device 100 includes an elongate housing 10 including a front face 12, and within which is positioned a pair of acoustic drivers 170*a* and 170*b* to acoustically output sound through the front face 12, which may be made acoustically porous to allow sound to pass therethrough with little resistance. Within the housing 10 is also a control circuit 150 that includes an orientation sensor 110 to detect the direction of the force of gravity, and to control one or more aspects of the acoustic output of sound by the acoustic drivers 170*a* and 170*b* in response to that orientation. Within the housing 10 may also be positioned a power source 90 (e.g., a battery, capacitor, voltage converter, etc.).

The housing 10 also includes various support surfaces by which the audio device 100 may be physically supported by another object external to the housing 10 (e.g., a floor, a piece of furniture, a portion of person's body, a wall or ceiling bracket, a ground surface, a rock or stone, a portion of a tree, etc.). Among these support surfaces may be a rear support surface 13; one or more side support surfaces 14, 15, 16 and/or 17; and/or one or more end support surfaces 18 and/or 19. As depicted, the side support surfaces 14 and 15, together, form what may be regarded as one elongate side of the elongate shape of the housing 10, and the side support surfaces 16 and 17, together, form an opposing elongate side of the same elongate shape. As will be explained in greater detail, the support surfaces 14-19 may be configured to enable the housing 10 (and thus, the audio device 100) to be physically supported by another object at any of a variety of orientations relative to the direction of the force of gravity. As will also be explained in greater detail, ones of the support surfaces on opposing sides and/or opposing ends of the housing 10 may be of asymmetric orientation relative to other portions of the housing to increase the variety of orientations at which the housing 10 may be physically supported.

As familiar to those skilled in the art, acoustic drivers typically acoustically output sound in a radiating pattern that defines a central axis along which acoustic output typically radiates with the highest amplitude. As depicted, each of the acoustic drivers 170*a* and 170*b* acoustically outputs sound with radiating patterns that define such axes 72*a* and 72*b*, respectively. Each of the acoustic drivers 170*a* and 170*b* may be any of a wide variety of types of acoustic driver, including and not limited to, electromagnetic or electrostatic based acoustic drivers. In some embodiments, the acoustic drivers 170*a* and 170*b* may be chosen to be of the same type with similar physical configurations and frequency responses to enable the use of the acoustic drivers 170*a* and 170*b* to provide stereo sound output with distinct left and right audio channels. In some embodiments, the axes 72*a* and 72*b* may extend parallel to each other. Alternatively, in other embodiments, the axes 72*a* and 72*b* may not be parallel to each other, but may extend in the same plane, such as in an embodiment in which the acoustic drivers 72*a* and 72*b* are angled relative to each other to disperse their acoustic outputs in a wider pattern or in a pattern directed towards a focal point at which the axes 72*a* and 72*b* cross.

The orientation sensor 110 may be based on any of a variety of types of orientation sensor including and not limited to, one or more accelerometers, or a gyroscope. Further, the orientation sensor 110 may be based on any of a variety of technologies to implement whatever type sensor component(s) on which the orientation sensor 110 is based, including and not limited to, micro-electro-mechanical systems (MEMS) technology. In embodiments in which the orientation sensor 110 is implemented as one or more accelerometers, the one or more accelerometers may be oriented to detect accelerations along three axes, such as the depicted axes 22, 25 and 28, to enable detection of the direction of the force of gravity in three dimensions. As depicted, the axes 22, 25 and 28 may include a longitudinal axis 28 oriented along the elongate dimension of the housing 10, a transverse axis 25, and a forward-rearward-axis 22, each at right angles to the others. As also depicted, the axes 22 and 28 may be oriented to extend in the same plane as the axes 72*a* and 72*b*, and the transverse axis 25 may be oriented to extend perpendicular to that plane. Indeed, in embodiments in which the axes 72*a* and 72*b* are parallel to each other, the forward-rearward axis 22 may be oriented to extend in parallel to the axes 72*a* and 72*b*.

Regardless of the manner in which the orientation sensor 110 is implemented, in some embodiments, the orientation sensor 110 may be employed to determine the relative positions of the axes 72*a* and 72*b* with respect to the direction of the force of gravity. Stated differently, the orientation sensor 110 may be employed to determine whether the plane within which the axes 72*a* and 72*b* extend is oriented more horizontally or more vertically, given the direction of the force of gravity. By way of example and turning to FIG. 1, the housing 10 has what might be referred to as a "landscape" orientation in which the acoustic drivers 170*a* and 170*b* are arranged substantially horizontally. As a result, a plane in which the axes 72*a* and 72*b* may both extend is caused to extend in an orientation that is more horizontal than vertical. In such an orientation, the acoustic drivers 170*a* and 170*b* may be operated to separately acoustically output distinct left and right audio channels of a sound (e.g., a left audio channel acoustically output by the acoustic driver 170*a* and a right audio channel acoustically output by the acoustic driver 170*b*). However, turning to FIG. 2, the housing 10 is rotated about the forward-rearward axis 22 (in a manner that may be referred to as "end-over-end" rotation) from the "landscape" orientation of FIG. 1 to what might be referred to as a "portrait" orientation in which the acoustic drivers 170*a* and 170*b* are arranged substantially vertically. As a result, a plane in which the axes 72*a* and 72*b* may both extend is caused to extend in an orientation that is more vertical than horizontal. In such an orientation, the separate acoustic output of distinct left and right audio channels may be deemed undesirable, and the acoustic drivers 170*a* and 170*b* may each be operated to output a mix of left and right audio channels of a sound.

By way of example, in embodiments in which the orientation sensor 110 is implemented as one or more accelerometers, a single accelerometer may be positioned to sense the direction of the force of gravity along one or both of the axes 25 and 28. In such embodiments, the "end-over-end" rotation of the housing 10 to a landscape orientation may be detected by detecting the direction of the force of gravity as aligned more with the transverse axis 25 than with the longitudinal axis 28. Correspondingly, an "end-over-end" rotation of the housing 10 about the forward-rearward axis 22 to a portrait orientation may be detected by detecting the direction of the force of gravity as aligned more with the longitudinal axis 28 than with the transverse axis 25. Where at least a single accelerometer of the orientation sensor 110 is positioned to sense the direction of the force of gravity along at least the transverse axis 25, that accelerometer may be employed to determine in which direction the force of gravity is acting along the transverse axis 25 to determine which of the acoustic drivers 170*a* and 170*b* to separately direct left and right audio channels to. Stated differently, depending on whether the landscape orientation of the audio device 100 results in the acoustic driver 170*a* on the left and the acoustic driver 170*b* on the right (from the perspective of looking at the front face 12) or vice versa, left audio channels may be directed to the acoustic driver 170*a* or 170*b*, and vice versa for right audio channels.

In addition to or as an alternative to determining the relative positions of the axes 72*a* and 72*b* with respect to the direction of the force of gravity, the orientation sensor 110 may be employed to determine orientation of the axes 72*a* and 72*b* with respect to the direction of the force of gravity. Stated differently, the orientation sensor 110 may be employed to determine the angle of elevation of the axes 72*a* and 72*b* with respect to a horizontal plane (e.g., a plane that perpendicular to the direction of the force of gravity). As previously discussed, the support surfaces 14-19 may be configured to enable the housing 10 to be physically supported in a variety of orientations enabling a variety of possible angles of elevation of the axes 72*a* and 72*b*.

Figure 3A:
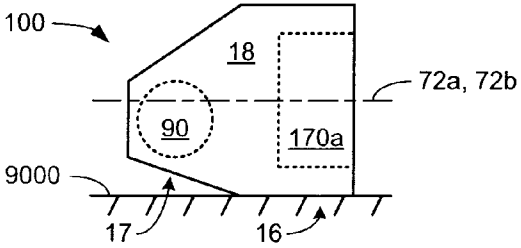
FIGS. 3A-C are end elevational views of the embodiments of FIGS. 1 and 2.
Figure 3B:
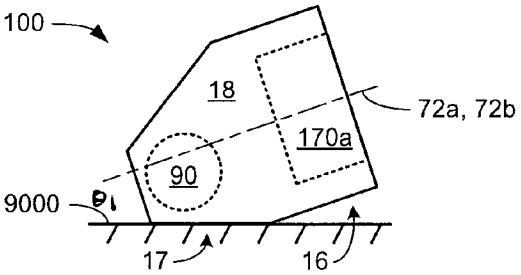
Figure 3C:
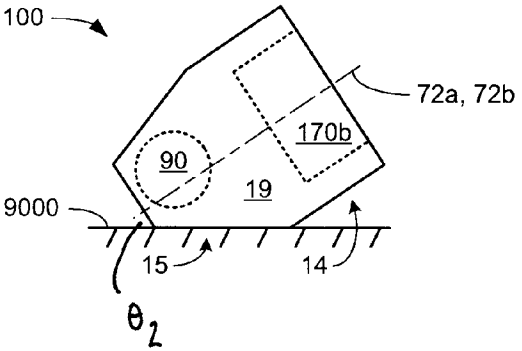

FIGS. 3A-C are a set of elevational views of the embodiment of the audio device 100 of FIGS. 1 and 2 from the perspective of viewing one or the other of the end support surfaces 18 and 19. More particularly, FIGS. 3A-C, together, depict an example of how the provision of multiple support surfaces 14-17 of asymmetric orientation on the opposing elongate sides of the housing 10 enables the audio device 100 to be physically supported atop a surface 9000 at a variety of orientations that enable a variety of angles of elevation for the axes 72*a* and 72*b*, relative to surface 9000 (e.g. $\theta_1$, $\theta_2$). In all three of these figures, the audio device 100 is physically supported in a landscape orientation atop a surface 9000 of another object external to the housing 10. As depicted in all three of these figures, the surface 9000 is substantially flat and horizontal such that the direction of the force of gravity may extend perpendicularly to the surface 9000, although it is to be understood that a substantially flat and horizontal surface to physically support the audio device 100 is not to be taken as a requirement.

FIG. 3A is an elevational view of the end support surface 18 in which the housing 10 is physically supported by the side support surface 16. As depicted, the side support surface 16 has an orientation that is substantially parallel to the axes 72*a* and 72*b* such that the axes 72*a* and 72*b* have a substantially horizontal elevation given that the surface 9000 engaging the side support surface 16 is substantially horizontal. It should be noted that the side support surface 14, which is of the opposing elongate side of the housing 10 from the side support surface 16, is depicted as substantially parallel to the side support surface 16 such that a similar horizontal elevation of the axes 72*a* and 72*b* may be achieved by physically supporting the audio device 100 atop the surface 9000 by the side support surface 14. However, other embodiments are possible in which the opposing elongate sides of the housing 10 are asymmetric such that the side support surfaces 14 and 16 are not parallel such that physically supporting the audio device 100 by one or the other of the side support surfaces 14 and 16 results in different angles of elevation for the axes 72*a* and 72*b*.

FIG. 3B is an elevational view of the end support surface 18 in which the housing 10 is physically supported by the side support surface 17. As depicted, the side support surface 17 has an orientation that differs from the side support surface 16 such that these two side support surfaces meet at an angle in forming one of the elongate sides of the elongate shape of the housing 10. As depicted, the side support surfaces 16 and 17 meet with a relatively sharp transition therebetween such that a ridge is formed along the length of this elongate side. However, in other embodiments, such transitions between support surfaces may be of a smoother and/or more rounded nature.

Taken together, FIGS. 3A and 3B demonstrate a possible result of controlling the distribution of weight of components of the audio device 100 to achieve a selected location of the center of gravity of the audio device 100 to enable a "bi-stable" response to rotating the audio device 100 about the longitudinal axis 28 (in a manner that may be referred to as a "log roll") between the two depicted orientations. Stated differently, at least relatively heavy components of the audio device 100, such as the acoustic drivers 170*a-b* and/or the power source 90, may be positioned within the housing 10 relative to the location of the transition between the side support surfaces 16 and 17 to enable the audio device 100 to stably remain in either of the two orientations depicted in FIG. 3A or 3B, at least when physically supported atop a horizontal surface.

FIG. 3C is an elevational view of the end support surface 19 in which the housing 10 is physically supported by the side support surface 15. As depicted, and as previously discussed, there may be an asymmetry in the orientations of the support sides in each of the opposing elongate sides of the housing 10 such that the side support surface 15 has an orientation within its elongate side that differs from its corresponding side support surface 17 of the opposing elongate side. As a result, physically supporting the audio device 100 on the surface 9000 by the side support surface 15 begets a different angle of elevation for the axes 72*a* and 72*b* relative to surface 9000 (e.g. $\theta_3$) than physically supporting the audio device 100 on the same surface 9000 by the side support surface 17. Also, not unlike the side support surfaces 16 and 17 of the opposing elongate side, the side support surfaces 14 and 15 are also depicted as meeting with a relatively sharp transition therebetween such that another ridge is formed along the length of this elongate side. Again, other embodiments are possible in which such transitions between support surface may be of a smoother and/or more rounded nature. Further, as was the case with the transition between the side support surfaces 16 and 17, components of the audio device 100 may be positioned within the housing 10 relative also to the location of the transition between the side support surfaces 14 and 15 to enable the audio device 100 to stably remain in either the orientation depicted in FIG. 3C or in another orientation in which the audio device 100 is physically supported by the side support surface 14 (not depicted), at least when physically supported atop a horizontal surface.

As also depicted in a comparison of FIG. 3C to either of FIG. 3A or 3B, the fact of the side support surface 15 being a portion of the elongate side opposite that of side support surfaces 16 and 17 requires that the audio device 100 be transitioned from one landscape orientation to the other. As a result, the acoustic drivers 170*a* and 170*b* are caused to exchange relative horizontal positions in terms of which is towards the left and which is towards the right from the perspective of looking at the front face 12. As previously discussed, such an exchange of relative positions of the acoustic drivers 170*a* and 170*b* may trigger a change in which of the acoustic drivers 170*a* and 170*b* is operated to acoustically output left audio channels and which is operated to acoustically output right audio channels.

Figure 4A:
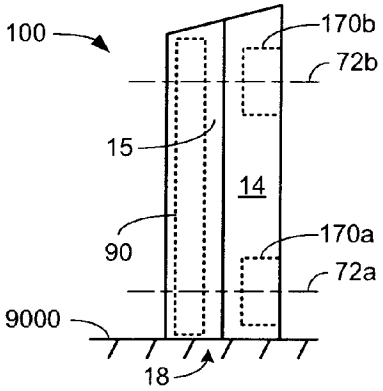
FIGS. 4A-B are side elevational views of the embodiment of FIGS. 1, 2 and 3A-C.
Figure 4B:
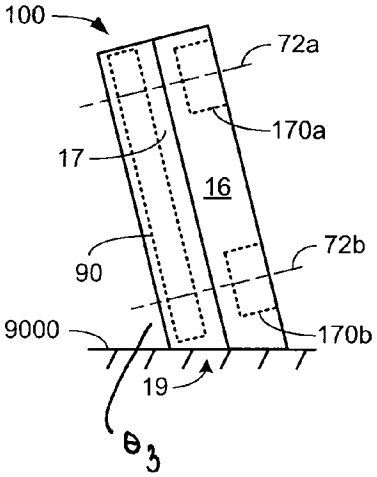

FIGS. 4A-B are a set of elevational views of the embodiment of the audio device 100 of FIGS. 1 and 2 from the perspective of viewing one or the other of the opposing elongate sides made up of the side support surfaces 14 and 15, and made up of the side support surfaces 16 and 17. More particularly, FIGS. 4A-B, together, depict an example of how the provision of multiple support surfaces 18-19 of asymmetric orientation on the opposing ends of the housing 10 enables the audio device 100 to be physically supported atop the surface 9000 at multiple orientations that enable a further variety of angles of elevation for the axes 72*a* and 72*b*. In both of these figures, the audio device 100 is physically supported in a portrait orientation atop the same surface 9000 of another object external to the housing 10.

FIG. 4A is an elevational view of the elongate side of the housing 10 made up of the side support surfaces 14 and 15 in which the housing 10 is physically supported by the end support surface 18. As depicted, the end support surface 18 has an orientation that is substantially parallel to the axes 72*a* and 72*b* such that the axes 72*a* and 72*b* have a substantially horizontal elevation given that the surface 9000 engaging the end support surface 18 is substantially horizontal.

FIG. 4B is an elevational view of the opposing elongate side of the housing 10 made up of the side support surfaces 16 and 17 in which the housing 10 is physically supported by the end support surface 19. As depicted, the ends of the housing 10 are asymmetric such that the end support surface 19 has an orientation that differs from the end support surface 18 relative to the axes 72*a* and 72*b*. As a result, rotating the housing 10 from one portrait orientation to the other (e.g., rotating between the orientations of FIGS. 4A and 4B) to change between supporting the audio device 100 by the end support surfaces 18 and 19 on the surface 9000 begets different angles of elevation for the axes 72*a* and 72*b*.

Taken together, FIGS. 4A and 4B demonstrate a possible result of controlling the distribution of weight of components of the audio device 100 to achieve a selected location of the center of gravity of the audio device 100 to enable stability in either of the two depicted orientations. Stated differently, at least relatively heavy components of the audio device 100, such as the acoustic drivers 170*a-b* and/or the power source 90, may be positioned within the housing 10 to enable the audio device 100 to stably remain in either of the two orientations depicted in FIG. 4A or 4B, at least when physically supported atop a horizontal surface.

In embodiments in which the orientation sensor 110 is implemented as one or more accelerometers, one or more accelerometers may be positioned to sense the direction of the force of gravity along one or both of the axes 22 and 25 to determine the elevation of the axes 72*a* and 72*b* as the audio device 100 is rotated in a "log roll" among such orientations as are depicted in FIGS. 3A-C. Correspondingly, one or more accelerometers may be positioned to sense the direction of the force of gravity along one or both of the axes 22 and 28 to determine the elevation of the axes 72*a* and 72*b* as the audio device 100 is rotated "end-over-end" among such orientations as are depicted in FIGS. 4A-B.

As familiar to those skilled in the art, depending on various aspects of the environment in which the audio device 100 is used, various characteristics of the sound acoustically output by the acoustic drivers 170*a* and 170*b* can be altered by a change in elevation of the axes 72*a* and 72*b*. Regardless of the manner in which the orientation sensor 110 is implemented, in some embodiments, the orientation sensor 110 may be employed to determine the angle of elevation of the axes 72*a* and 72*b* as an input to a determination of whether to alter a characteristic of the sound that is acoustically output and/or to what degree. More specifically, the control circuit 150 may employ indications received from the orientation sensor 110 of the angle of elevation of the axes 72*a* and 72*b* to control one or more filters to alter amplitude and/or timing characteristics of one or more audio channels of sound that the acoustic drivers 170*a* and 170*b* are driven to acoustically output. By way of example, the amplitude of lower frequencies (commonly referred to as "bass sounds") may be selectively altered in response to the angle of elevation.

Figure 5:
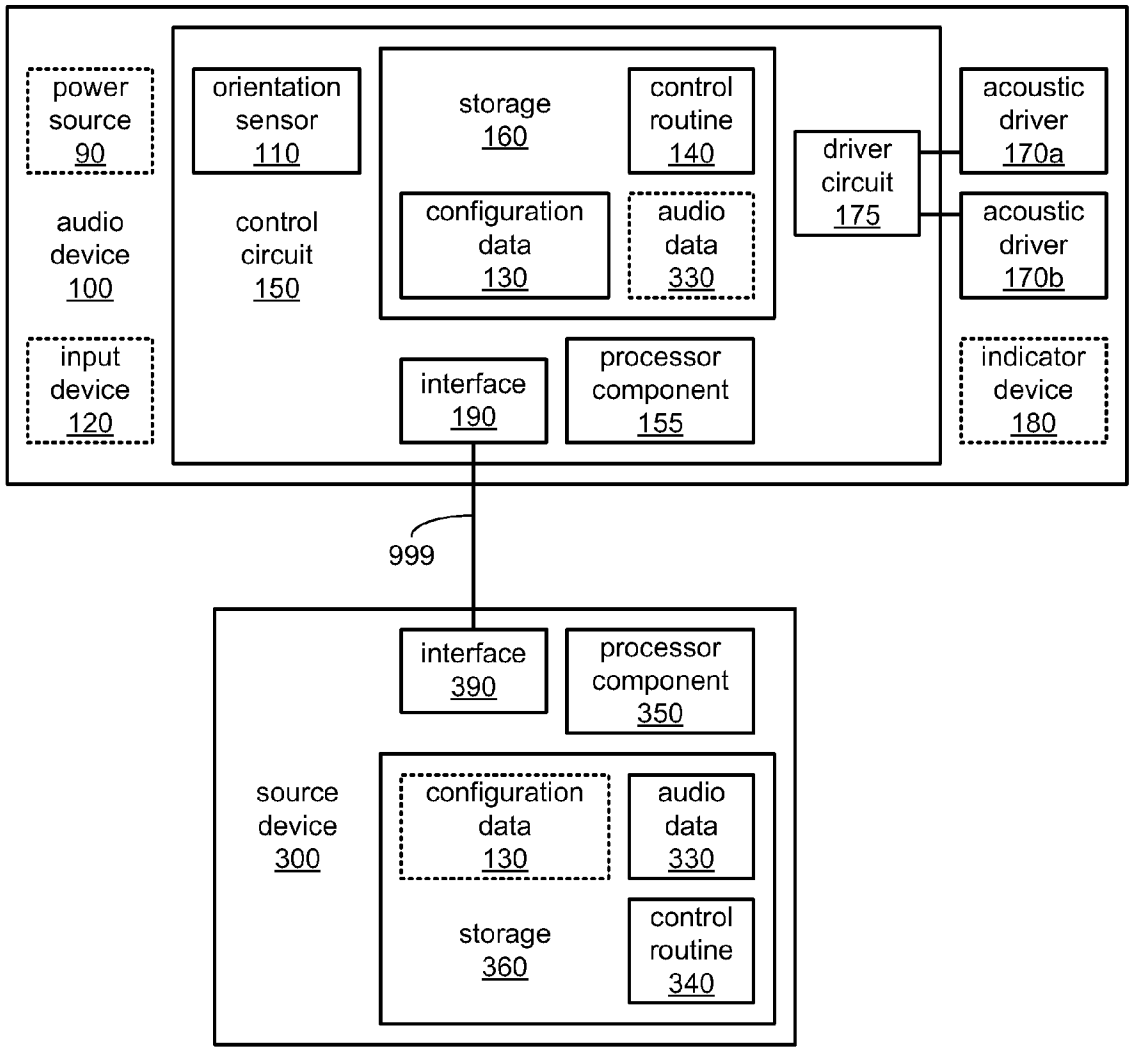
FIG. 5 is a block diagram of an embodiment of an audio system incorporating an embodiment of an audio device.

FIG. 5 depicts an embodiment of an architecture of an audio system 1000 that incorporates an embodiment of the audio device 100 to acoustically output sound digitally represented by audio data 330. Also incorporated into the audio system 1000 may be at least one source device 300 coupled to the audio device 100 by a communications link 999.

As depicted, the control circuit 150 of the audio device 100 may be implemented at least partly as a computing device incorporating one or more of the orientation sensor 110, a processor component 155, a storage 160, a driver circuit 175 and an interface 190. In addition to one or more of the power source 90, the control circuit 150 and the acoustic drivers 170*a* and 170*b*, the audio device 100 may also incorporate one or both of an input device 120 and an indicator device 180. The storage 160 stores one or more of configuration data 130, a control routine 140 and audio data 330. The control routine 140 incorporates a series of instructions implementing logic, that when executed by the processor component 155, cause the processor component 155 to perform functions described herein.

The processor component 155 may include any of a wide variety of commercially available processors. Further, the processor component 155 may include multiple processors, a multi-threaded processor, a multi-core processor (whether the multiple cores coexist on the same or separate dies), and/or a multi processor architecture of some other variety by which multiple physically separate processors are in some way linked.

The storage 160 may be based on any of a wide variety of information storage technologies. Such technologies may include volatile technologies requiring the uninterrupted provision of electric power and/or technologies entailing the use of machine-readable storage media that may or may not be removable. It should be noted that although the storage 160 is depicted as a single block, the storage 160 may include multiple storage components that may each be based on differing storage technologies. Alternatively or additionally, the storage 160 may include multiple storage components based on identical storage technology, but which may be separately operated as a result of specialization in use.

The interface 190 couples the processor component 155 and/or other components of the control circuit 150 to the communications link 999, thereby enabling communications with a source of the audio data 330, such as the source device 300. The interface 190 may be based on any of a variety of communications technologies appropriate for coupling to the communications link 999. In some embodiments, the communications link 999 may be cabling-based such that fiber optic and/or electrically conductive cabling is employed to form the communications link 999. In such embodiments, the interface 190 may implement a communications interface adhering to any of a variety of optical and/or electrical communications specifications, including and not limited to, Universal Serial Bus (USB), Ethernet, Inter-Integrated Circuit (I2C), etc. In other embodiments, the communications link 999 may be based on wireless communications such that infrared (IR) light, radio waves, etc. are employed to form the communications link 999. In such embodiments, the interface 190 may implement a communications interface adhering to any of a variety of light-based and/or radio frequency (RF) communications, including and not limited to, Infrared Data Association (IrDA), Bluetooth, etc. Further, the communications link 999 may be a direct point-to-point link between with a source of the audio data 330, such as the source device 300, or may be a wired and/or wireless network coupling multiple devices.

The driver circuit 175 is coupled to the acoustic drivers 170*a* and 170*b* to drive the acoustic drivers 170*a* and 170*b* with appropriate signals to acoustically generate sounds represented by the audio data 330 under the control of the processor component 155. The driver circuit 175 may incorporate amplification and/or digital-to-analog (D-to-A) conversion components as appropriate to enable operation of the acoustic drivers 170*a* and 170*b*.

In some embodiments, in executing the control routine 140, the processor component 155 operates the interface 190 to receive the audio data 330, stores at least a portion of the audio data 330 within the storage 160, and then operates the driver circuit 175 to drive the acoustic drivers 170*a* and 170*b* to acoustically output the sounds represented by the audio data 330. The audio data 330 may digitally represent sound in any of a variety of compressed or non-compressed formats, including and not limited to, Motion Picture Experts Group Layer 3 (MP3), Windows Media Audio (WMA), Free Lossless Audio Compression (FLAC), etc. Such digital representation of sound may be with any of a wide range of sampling frequencies and bit depths. The sounds may be represented by the audio data 330 in a manner in which there are multiple audio channels, such as stereo audio and/or surround sound audio.

The input device 120, if present, may be any of a variety of types of manually operable input device, including and not limited to, a touchpad, joystick, one or more switches, a keypad, etc. The indicator device 180, if present, may be any of a variety of audible and/or visual indicators, including and not limited to, a buzzer, a light (e.g., a light-emitting diode), an alphanumeric and/or all-points-addressable display, etc. Alternatively, the input device 120 and the indicator device 180 may be combined into a single device, such as a touch-screen display. As yet another alternative, where sound is used to provide indications, one or both of the acoustic drivers 170*a* and 170*b* may be employed to provide such indications in place of the indicator device 180.

In executing the control routine 140, the processor component 155 may be caused to operate the input device 120 and/or the indicator device 180 to provide a user interface that enables an operator of at least the audio device 100 to control the acoustic output of sounds by the acoustic drivers 170*a* and 170*b*. By way of example, the processor component 155 may monitor the input device 120 for indications of operation of the input device 120 to convey a command to acoustically output sounds and/or to cease doing so (e.g., a power on/off command, a "mute" command, etc.), to convey a command to alter a characteristic of the acoustic output of sounds (e.g., a command to increase or decrease a "volume" level), to select the sounds acoustically output (e.g., a "fast-forward", "reverse" or "track" selection command), etc. One or more of such commands may trigger the processor component 155 to communicate with the source device 300 via the communications link 999 to convey one or more commands thereto (e.g., a "fast-forward" or "reverse" command).

As has been discussed, the orientation sensor 110 may be made up of one or more orientation sensing components (e.g., a gyroscope and/or one or more accelerometers) and may be based on any of a variety of technologies. In executing the control routine 140, the processor component 155 may monitor the orientation sensor 110 for signals conveying raw indications of the orientation of the orientation sensor 110 relative to the direction of the force of gravity. The processor component 155 may retrieve and employ at least a portion of the configuration data 130 to determine the orientation and/or relative positions of the axes 72*a* and 72*b* of the acoustic drivers 170*a* and 170*b*, respectively, with respect to the direction of the force of gravity. The configuration data 130 may provide an indication of the correlation between at least one orientation sensing component of the orientation and/or position of one or more components of the orientation sensor 110 and the orientations and/or positions of the axes 72*a* and 72*b*.

Figure 6:
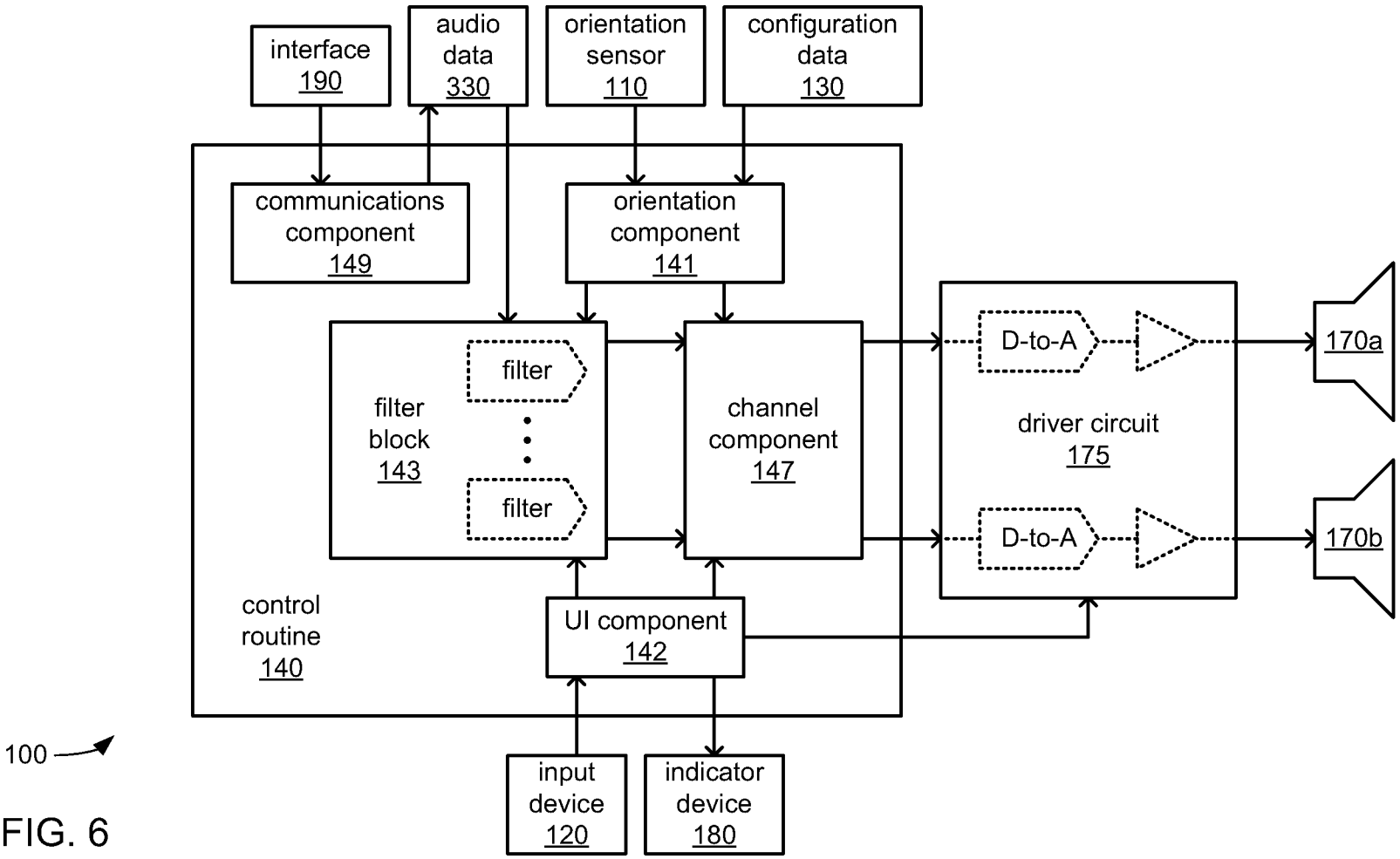
FIG. 6 is a block diagram of a portion of at least an embodiment of a control circuit of an audio device.

FIG. 6 depicts an embodiment of a portion of the audio device 100 and/or the audio system 1000 in greater detail. More specifically, FIG. 6 depicts aspects of a possible operating environment of at least an embodiment of the control circuit 150. As recognizable to those skilled in the art, the control routine 140, including the components of which it is composed, is selected to be operative on whatever type of processor or processors that are selected to implement the processor component 155. The control routine 140 may include one or more of an operating system, device drivers and/or application-level routines (e.g., so-called "software suites" provided on disc media, "applets" obtained from a remote server, etc.). Where an operating system is included, the operating system may be any of a variety of available operating systems appropriate for the processor component 155. Where one or more device drivers are included, those device drivers may provide support for any of a variety of other components, whether hardware or software components, of the processor component 155, the control circuit 150 and/or the audio device 100.

The control routine 140 may include a communications component 149 executable by the processor component 155 to operate the interface 190 to transmit and receive signals via the communications link 999 as has been described. Among the signals received may be signals conveying the audio data 330 among the audio device 100, the source device 300 and/or one or more other devices (not shown) via the communications link 999. As recognizable to those skilled in the art, the communications component 149 is selected to be operable with whatever type of interface technology is selected to implement the interface 190, whether a wired or wireless interface and regardless of whether analog and/or digital signals are exchanged.

The control routine 140 may include a filter block 143 executable by the processor component 155 to operate and/or instantiate one or more digital filters to controllably alter sound represented by the audio data 330. Such an alteration may include one or more of changes in level, amplitude, range of frequencies or equalization among frequencies. Such an alteration may include one or more of shifting of timing among ranges of frequencies and/or of the entirety of the represented sound. The digital filters of the filter block 143 may implement any of a variety of transforms, including transforms into and/or out of the frequency domain, to effect such an alteration.

The control routine 140 may include a channel component 147 executable by the processor component 155 to selectively allocate one or more audio channels of the sound represented by the audio data 330 towards one or more acoustic drivers, such as the acoustic drivers 170*a* and/or 170*b*. In some embodiments, the channel component 147 may allocate one or more left and/or right audio channels towards one or the other of the acoustic drivers 170*a* and/or 170*b* to selectively provide a stereo and/or surround sound effect. Alternatively or additionally, the channel component 147 may mix one or more left and/or right audio channels to generate one or more mixtures of such channels to allocate towards the acoustic drivers 170*a* and/or 170*b*.

In some embodiments, the channel component 147 may be provided with the audio data 330 after possible alteration effected by the filter block 143, as depicted. In other embodiments, this order may be reversed such that the filter block 143 is provided with the audio data 330 after selective allocation of audio channels of sound represented by the audio data 330 towards one or both of the acoustic drivers 170*a* and 170*b*. In still other embodiments, the function of the channel component 147 may be subsumed by the filter block 143 such that one or more digital filters are employed to effect allocation and/or mixing of audio channels.

Regardless of the exact manner and/or order in which sound represented by the audio data 330 is altered and/or allocated towards one or both of the acoustic drivers 170*a* and 170*b*. As part of effecting such allocation, one or more of such allocated audio channels may be directed by one or both of the filter block 143 and/or the channel component 147 by being directed towards the driver circuit 175. Again, the driver circuit 175 may incorporate one or more digital-to-analog (D-to-A) converters to convert allocated audio channels of the sound represented by the audio data 330 (whether altered, or not) into one or more analog signals. Again, the driver circuit 175 may incorporate one or more amplifiers to amplify the one or more analog signals to drive the acoustic drivers 170*a* and/or 170*b*.

The control routine 140 may include an orientation component 141 executable by the processor component 155 to control the altering of sound represented by the audio data 330 by the filter block 143 and/or the allocation of audio channels by the channel component 147 in response to the direction of the force of gravity. The orientation component 141 monitors the orientation sensor 110 to receive indications therefrom of the direction of the force of gravity. Again, the orientation sensor 110 may be made up of one or more accelerometers and/or gyroscopes. The orientation component 141 may derive the direction of the force of gravity from multiple indications of dimensional components of the direction of the force of gravity. The orientation component may retrieve indications of filter configurations and/or allocations of audio channels to employ in response to one or more specific directions of the force of gravity detected by the orientation sensor 110.

By way of example, the orientation component 141 may signal the channel component 147 to effect allocations of left and right audio channels to different ones of the acoustic drivers 170*a* and 170*b* based on indications in the configuration data 130 of what allocations of audio channels are to be effected in response to specific detected directions of the force of gravity. Alternatively or additionally, the orientation component 141 may signal the channel component 147 to allocate a mixture of left and right audio channels to one or both of the acoustic drivers 170*a* and 170*b* based on indications in the configuration data 130 of when mixed audio channels are to be so allocated in response to specific detected directions of the force of gravity.

Thus, in response to detecting a direction of the force of gravity consistent with the audio device 100 being in the landscape orientation of FIG. 1 (or at least oriented more in a landscape orientation than in a portrait orientation), the orientation component 141 may be caused by indications of allocation of audio channels of the configuration data 130 for landscape orientations to signal the channel component 147 to allocate left and right audio channels to different ones of the acoustic drivers 170*a* and 170*b*. Further, the orientation component 141 may employ the detected direction of the force of gravity to determine which of the acoustic drivers 170*a* and 170*b* are to be allocated the left and right audio channels such that a person facing the front face 12 will be presented with a stereo effect in which a left audio channel is acoustically output by whichever one of the acoustic drivers 170*a* and 170*b* is positioned more towards their left and in which a right audio channel is acoustically output by whichever one of the acoustic drivers 170*a* and 170*b* is positioned more towards their right.

Alternatively or additionally, in response to detecting a direction of the force of gravity consistent with the audio device 100 being in the portrait orientation of FIG. 2 (or at least oriented more in a portrait orientation than in a landscape orientation), the orientation component 141 may be caused by indications of allocation of audio channels of the configuration data 130 for portrait orientations to signal the channel component 147 to allocate a mixture of left and right audio channels both of the acoustic drivers 170*a* and 170*b*. This may be done based on the ability to provide a stereo effect (and/or a surround sound effect) being greatly impaired by the acoustic drivers 170*a* and 170*b* being more vertically aligned than horizontally aligned in a portrait orientation.

By way of another example, the orientation component 141 may signal the filter block 143 to selectively configure one or more digital filters to either effect an alteration of sound represented by the audio data 330, or not, based on the angle of elevation of one or both of the axes 72*a* and 72*b*. Alternatively or additionally, the orientation component 141 may signal the filter block 143 to selectively configure one or more digital filters to effect different alterations of sound represented by the audio data 330 based on the angle of elevation of one or both of the axes 72*a* and 72*b*. In some embodiments, the orientation component 141 may calculate one or more aspects of the configuration for one or more digital filters of the filter block 143 based on the angle of elevation of one or both of the axes 72*a* and 72*b*. In such embodiments, the configuration data 130 may provide one or more parameters (e.g., coefficients, mathematical models, etc.) employed in performing such calculations. In other embodiments, the orientation component 141 may compare the detected angle of elevation of one or both of the axes 72*a* and 72*b* to one or more angles of elevation stored in the configuration data 130 and retrieve a configuration for one or more digital filters of the filter block 173 that is associated with whichever one of those stored angles of elevation is closest to that detected angle of elevation.

As has been discussed with reference to FIGS. 1, 2, 3A-C and 4A-B, physically supporting the audio device 100 atop a substantially horizontal surface via one of the support surfaces 14-19 can result in placing one or both of the axes 72*a* and 72*b* in any of a variety of angles of elevation relative to a horizontal plane that is normal to the direction of the force of gravity. In some embodiments, the configuration data 130 may store configurations of digital filters for the filter block 173 that are correlated to specific angles of elevation that are associated with physically supporting the audio device 100 atop a substantially horizontal surface via particular ones of the support surfaces 14-19.

As familiar to those skilled in the art, changes to an angle of elevation of an axis associated with an acoustic driver can cause a change in characteristics of sound acoustically output by that acoustic driver, at least as perceived by a person listening to it. Among such changes may be a change in the perceived relative amplitude of bass sounds (e.g., lower frequency sounds) in comparison to the amplitude(s) of non-base sounds (e.g., higher frequency sounds). Such a relative difference in amplitude may be increased and/or decreased as the angle of elevation is increased and/or decreased. Thus, regardless of whether the orientation component 141 derives or retrieves configurations for digital filters of the filter block 143 in response to detecting different angles of elevation of the axes 72*a* and/or 72*b*, the orientation component 141 may signal the filter block 143 with differing configurations of digital filters selected to increase or decrease the amplitude of base sounds relative to non-base sounds to differing degrees based on the specific angle of elevation detected.

The control routine 140 may include a user interface (UI) component 142 executable by the processor component 155 to operate the input device 120 and the indicator device 180 to provide a user interface to enable operation of the audio device 100 to acoustically output sounds represented by the audio data 330. The UI component 142 may monitor the controls 120 for indications of manual operation thereof to convey various commands affecting the acoustic output of such sound. The UI component 142 may operate the indicator device 180 to provide visual acknowledgement of such manual operation of the controls 120. Alternatively or additionally, the UI component 142 may cooperate with one or more other components (e.g., one or both of the filter block 143 and the channel component 147) to employ the acoustic drivers 170*a* and/or 170*b* to provide an audible acknowledgement of such manual operation of the controls 120 (e.g., a "beep" or other indicator sound).

Among the commands that may be received by the UI component 142 through such manual operation may be commands that alter one or more characteristics of sound represented by the audio data 330 and/or one or more characteristics of the acoustic output of that sound by the acoustic drivers 170*a* and/or 170*b*. By way of example, a command to alter the equalization of frequencies (e.g., adjust treble and/or bass levels) may be received, and in response, the UI component 142 may signal the filter block 143 to alter a configuration of one or more digital filters to effect such a change. By way of another example, a command to alter the volume level of the acoustic output by may be received, and in response, the UI component 142 may signal the driver circuit 175 to alter the amplitude imparted by amplifiers thereof in driving the acoustic drivers 170*a* and/or 170*b*.

It should be noted that despite the specific discussion herein of an embodiment of the control circuit 150 based on execution of instructions by the processor component 155, other embodiments are possible in which such functionality to alter the acoustic output of sound based on orientation (including landscape vs. portrait and/or angle of elevation) is implemented without a processor component (e.g., via analog circuitry). It should also be noted that despite the specific discussion herein of an embodiment of the audio device 100 in which sound to be acoustically output is received and/or stored for processing in a digital representation, other embodiments are possible in which such sound is received as analog signal and/or in which the sound is altered via analog circuitry.

Figure 7:
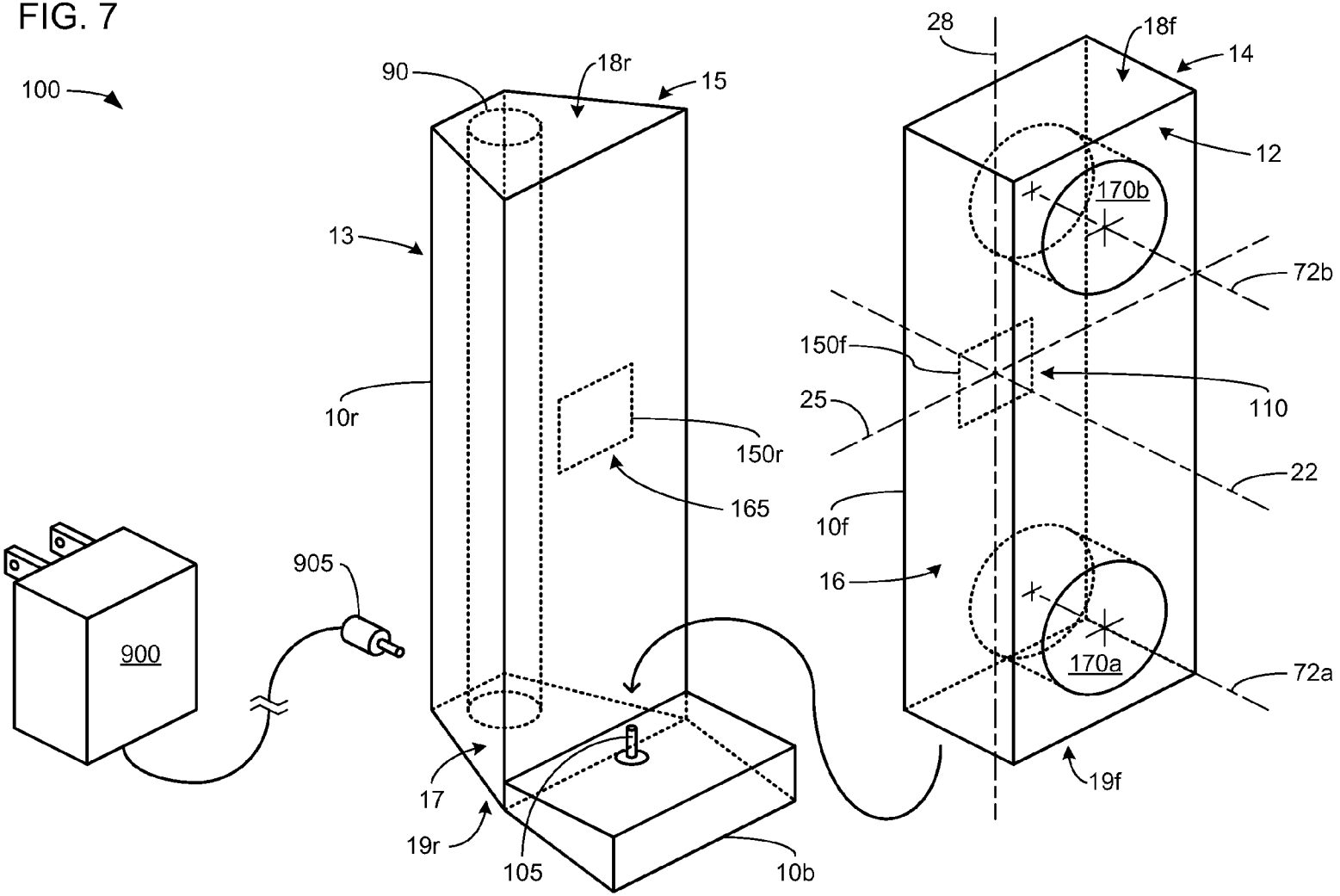
FIG. 7 is a perspective view of an alternate embodiment of an audio device.

FIG. 7 is an exploded perspective view of an alternate embodiment of the audio device 100 to acoustically output sound, such as music, speech, etc. The embodiment of the audio device 100 of FIG. 7 is similar to the embodiment of the audio device 100 of FIG. 1 in many ways, and thus, like reference numerals are used to refer to like components throughout. However, unlike the single-piece housing 10 of the audio device 100 of FIG. 1, the housing 10 of the audio device 100 of FIG. 7 is made up of a front housing portion 10*f* incorporating the acoustic drivers 170*a* and 170*b*, and a separate rear housing portion 10*r* incorporating the power source 90 and able to be physically and/or electrically coupled to the front housing portion 10*f*.

As depicted, the front housing portion 10*f* and the rear housing portion 10*r* of the housing 10 are able to be joined generally at the vicinity of the earlier described transitions between the side support surfaces 14 and 15 and between the side support surfaces 16 and 17. As also depicted, the separation between the housing portions 10*f* and 10*r* split the end support surface 18 into a front portion 18*f* and a rear portion 18*r* of the end support surface 18, while the end support surface 19 remains an unbroken support surface.

As further depicted, at least the rear housing portion 10*r* of the housing 10 incorporates a connector 105 by which the front housing portion 10*f* and the rear housing portion 10*r* are able to be electrically coupled. Through such an electric coupling may be conveyed signals representing sound to be acoustically output, electric power from the power source 90 and/or signals conveying commands affecting the acoustic output of sound by the acoustic drivers 170*a* and/or 170*b*. In embodiments in which such an electric coupling may convey electric power, the front housing portion 10*f* may alternately be provided with electric power via a connector 905 of an external power source 900 (e.g., a so-called "wall transformer" able to convey electric power provided by AC mains, as depicted).

As still further depicted, the control circuit 150 of the embodiment of the audio device 100 of FIG. 1 may, in the embodiment of the audio device 100 of FIG. 7, be split into control circuit portions 150*f* and 150*r* of the control circuit 150 incorporated into the housing portions 10*f* and 10*r*, respectively, of the housing 10. As will be explained in greater detail, the control circuit portion 150*f* may incorporate the orientation sensor 110 and may alter the acoustic output of sound by the acoustic drivers 170*a* and/or 170*b* in response to the detected direction of the pull of gravity, while the control circuit portion 150*r* may incorporate an additional storage 165 by which the configuration data 130 (maintained within the control circuit portion 150*f*) may be augmented with additional configuration data.

Thus, the front housing portion 10*f* of the embodiment of the audio device 100 of FIG. 7 may be operated separately from the rear housing portion 10*r* to acoustically output sound. In so doing, the front housing portion 10*f* may be provided with electric power by the external power source 900 in lieu of being provided with electric power from the power source 90 incorporated into the rear housing portion 10*r*. Further, the control circuit portion 150*f* of the control circuit 150 incorporated into the front housing portion 10*f* may operate the orientation sensor 110 (also incorporated into the front housing portion 10*f*) to detect the direction of the direction of the pull of gravity and to alter the acoustic output of sound by the acoustic drivers 170*a* and/or 170*b* in response. Thus, the orientation of the front housing portion 10*f* may be determined (e.g., differentiating between landscape and portrait orientations and/or determining the angle of elevation of the axes 72*a* and/or 72*b*), and in response, audio channels may be allocated and/or characteristics of the acoustic output of sound may be altered.

Figure 8:
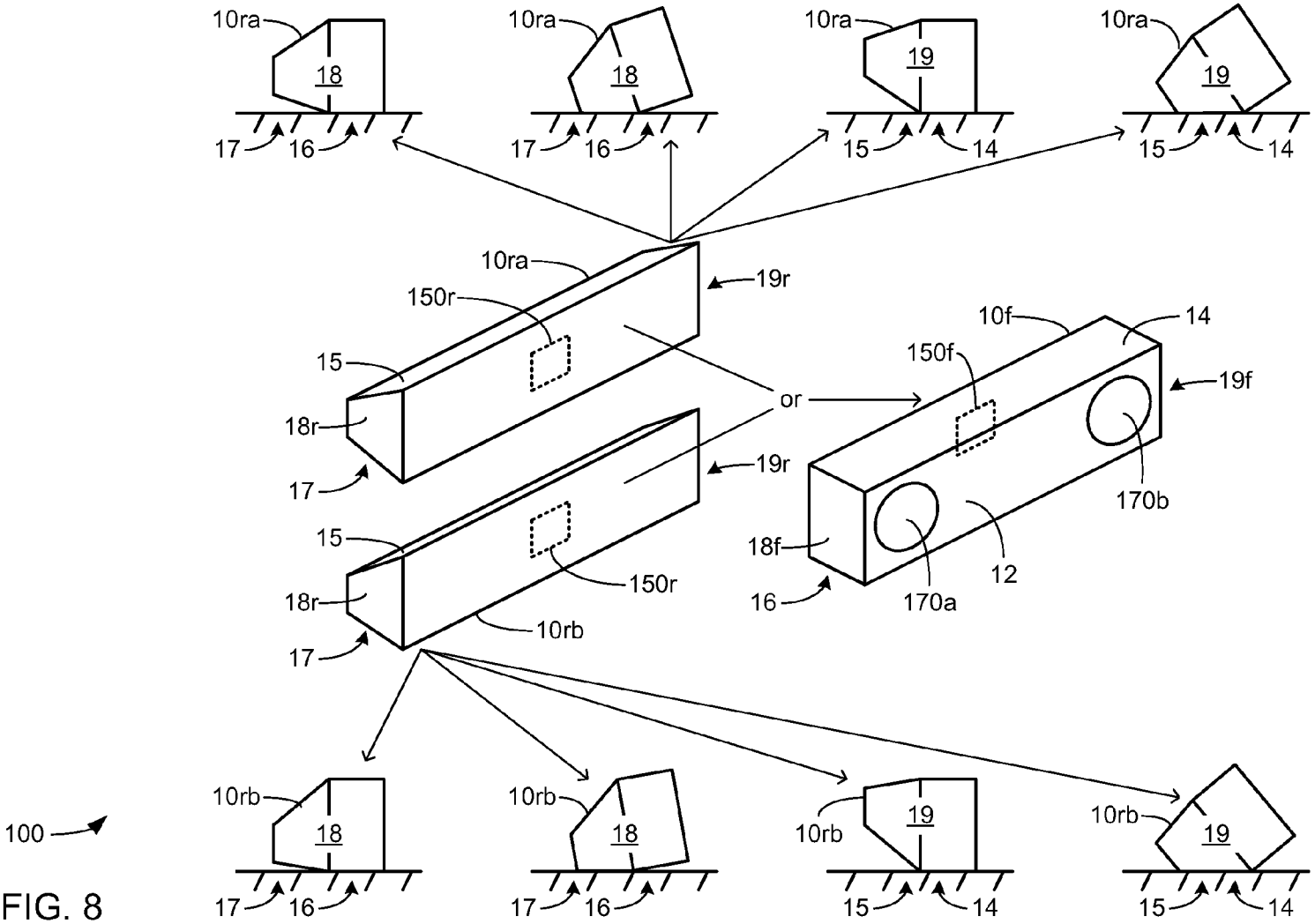
FIG. 8 is a combination of an exploded perspective view and multiple end elevation views of another alternate embodiment of an audio device.

FIG. 8 is an exploded perspective view and accompanying end elevational views of another alternate embodiment of the audio device 100 to acoustically output sound, such as music, speech, etc. The embodiment of the audio device 100 of FIG. 8 is similar to the embodiments of the audio device 100 of FIG. 7 in many ways, and thus, like reference numerals are used to refer to like components throughout. However, unlike the two-piece housing 10 of the audio device 100 of FIG. 7, the manner in which the housing 10 of the audio device 100 of FIG. 8 is divided into two portions is somewhat different such that both of the end support surfaces are divided into two portions. Also, unlike the two-piece housing 10 of the audio device 100 of FIG. 7, there are multiple interchangeable rear housing portions 10*ra* and 10*rb* for the housing 10 of the audio device 100 of FIG. 8. Each of the interchangeable rear housing portions 10*ra* and 10*rb* may incorporate ones of the power source 90 such that either could provide electric power to the front housing portion 10*f*.

As depicted, the rear housing portions 10*ra* and 10*rb* of the housing 10 of FIG. 8 each have asymmetrically oriented side support surfaces 15 and 17, just as does the rear housing portion 10*r* of the housing 10 of FIG. 7 and the housing 10 of FIG. 1. Like the rear housing portion 10*r* of FIG. 7, each of the rear housing portions 10*ra* and 10*rb* of FIG. 8 may incorporate one of the power source 90 and/or one of the control circuit portion 150*r*. However, the asymmetric orientations of the side support surfaces 15 and 17 of the rear housing portion 10*ra* differ from those of the rear housing portion 10*rb*. Thus, exchanging one of the of the rear housing portions 10*ra* and 10*rb* for the other creates a different combination of orientations of side support surfaces for the housing 10. The end elevation views of FIG. 8 depict the different combinations of orientations enabled by use of one or the other of the rear housing portions 10*ra* and 10*rb*. Such different combinations of orientations may also enable different combinations of angles of elevation of the axes 72*a* and/or 72*b* when the housing 10 is supported atop a substantially horizontal surface via the different ones of the side support surfaces 15 and 17 of the rear housing portions 10*ar* and 10*rb*.

Figure 9:
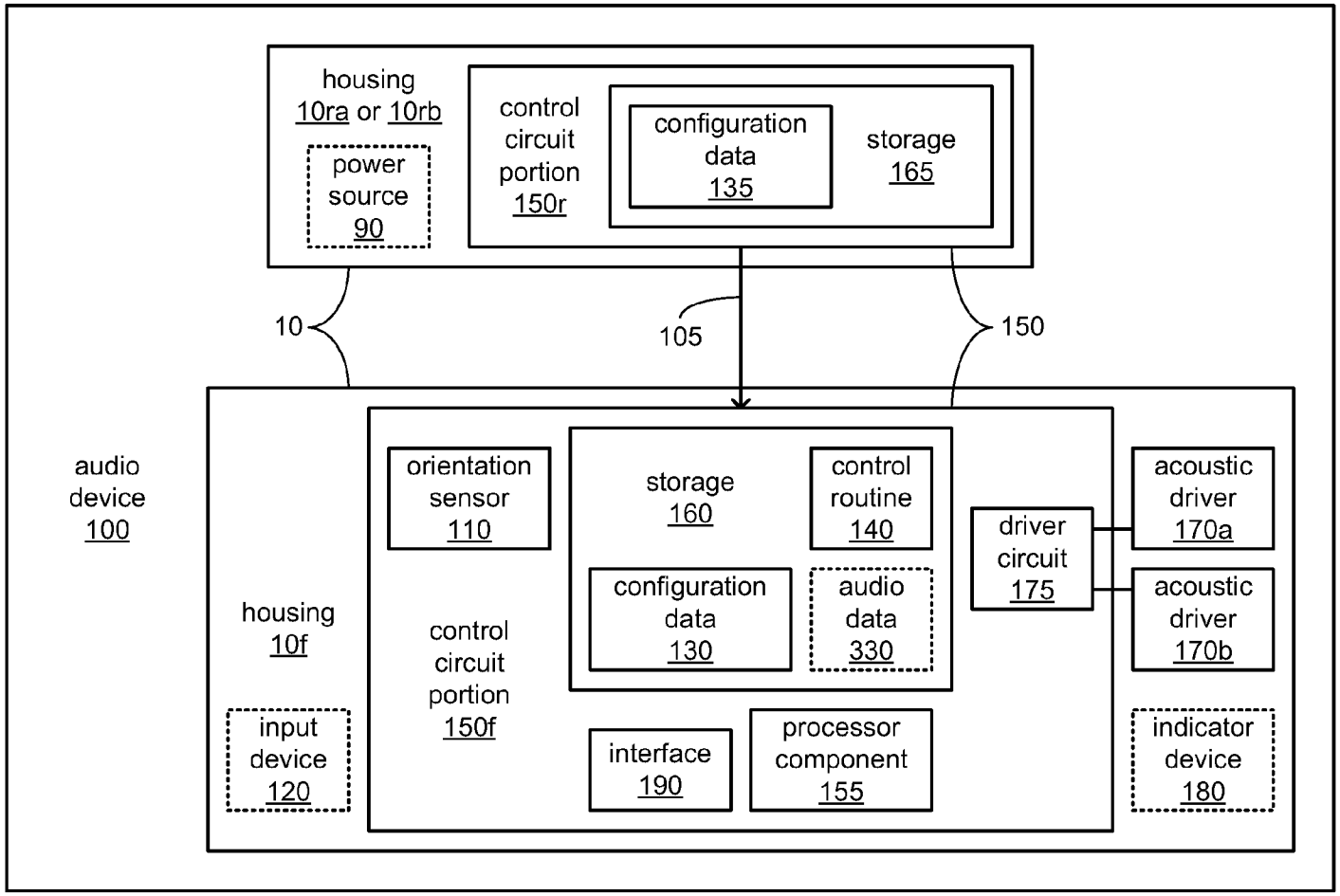
FIG. 9 is a block diagram of still another alternate embodiment of an audio device.

FIG. 9 depicts an embodiment of an architecture that may be employed by one of the alternate embodiments of the audio device 100 of FIG. 7 or 8. The architecture of the audio device 100 of FIG. 9 is similar to the architecture of the audio device 100 of FIG. 5 in many ways, and thus, like reference numerals are used to refer to like components throughout. However, unlike the architecture of the audio device 100 of FIG. 5, the architecture of the audio device 100 of FIG. 9 incorporates the split in the control circuit 150 into control circuit portions 150*f* and 150*r* first described in reference to FIG. 7. As previously discussed, the control circuit portion 150*f* incorporated into the front housing portion 10*f* monitors the orientation sensor 110 and alters the acoustic output of sound by the acoustic drivers 170*a* and/or 170*b* in response to the direction of the force of gravity. As also previously discussed, the control circuit portion 150*r* incorporated into a rear housing portion of the housing 10 may incorporate an additional storage 165 in which may be stored additional configuration data (specifically, configuration data 135) to supplement the configuration data 130 maintained within the control circuit portion 150*f*.

As discussed with regard to FIG. 8, there may be more than one interchangeable rear housing portions, such as the rear housing portions 10*ra* and 10*rb*, and each of these rear housing portions 10*ra* and 10*rb* may incorporate one of the control circuit portion 150*r*. Thus, each of the rear housing portions 10*ra* and 10*rb* may incorporate a one of the storage 165 including a one of the configuration data 135 with which to supplement the configuration data 130. As discussed with regard to FIG. 5, the configuration data 130 may incorporate indications of digital filter configurations correlated to specific angles of orientation of the axes 72*a* and/or 72*b*, and each of those specific angles of orientation may be associated with physically supporting the audio device 100 atop a substantially horizontal surface via a specific one of the support surfaces 14-19. In such embodiments, the configuration data 135 incorporated within each of the rear housing portions 10*ra* and 10*rb* may augment the configuration data 130 with specific filter configurations correlated with specific angles of elevation that may be associated with physically supporting the audio device 100 via one of the side support surfaces 15 or 17 of the particular one of the rear housing portions 10*ra* or 10*rb*. In essence, since each of the rear housing portions 10*ra* and 10*rb* incorporates side support surfaces 15 and 17 of different orientations from the other, the provision of the configuration data 135 may enable the control circuit portion 150*f* to better respond to the particular elevation angles of the axes 72*a* and/or 72*b* enabled by a particular one of the rear housing portions 10*ra* or 10*rb*. Upon coupling one or the other of the rear housing portions 10*ra* or 10*rb* to the front housing portion 10*f*, the particular one of the configuration data 135 may become accessible to the control circuit portion 150*f* via the connector 105.

Having described the invention, and a preferred embodiment thereof, what we claim as new, and secured by letters patent, is:

1. An audio device for placement on a surface, comprising:

a housing incorporating a first support surface and a second support surface by which the audio device may be physically supported, the first and second support surfaces providing the audio device with different orientations relative to the surface on which the audio device is placed;

a first acoustic driver incorporated into the housing to acoustically output sound in a radiating pattern associated with a first axis of the first acoustic driver;

an orientation sensor incorporated into the housing to detect a direction of a force of gravity; and a control circuit coupled to the first acoustic driver and the orientation sensor, the control circuit to:

operate the orientation sensor to determine the direction of the force of gravity relative to the first axis;

determine whether the first axis is oriented to one of a first angle of elevation associated with physically supporting the audio device by the first support surface and a second angle of elevation associated with physically supporting the audio device by the second support surface; wherein the first and second angles of elevation are different and non-zero relative to the surface on which the device is placed and alter a characteristic of acoustic output of sound by the first acoustic driver based on the first axis being oriented to one of the first and second angles of elevation, wherein:

the housing comprises and is separable into a first housing portion and a second housing portion;

the first housing portion comprises the first acoustic driver, the orientation sensor and the control circuit; and the second housing portion comprises a power source, and the first and second support surfaces, and wherein:

the control circuit comprises a filter block that employs at least one digital filter to alter the characteristic; and the second housing portion comprises a storage that stores indications of a first digital filter configuration associated with the first support surface and a second digital filter configuration associated with the second support surface, the control circuit to configure the at least one digital filter with the first or second filter configuration based on the first axis being oriented to one of the first and second angles of elevation.

2. The audio device of claim 1, the housing comprising a side that comprises the first and second support surfaces, the first and second support surfaces meeting at an angle.

3. The audio device of claim 2, the housing having a generally elongate shape associated with a longitudinal axis extending lengthwise along the elongate shape, wherein:

transitioning from physically supporting the audio device by the first support surface to physically supporting the audio device by the second support surface entails rotating the housing about the longitudinal axis; and weights of the first acoustic driver and at least one other component of the audio device are distributed to enable stability in physically supporting the audio device by either the first or second support surfaces.

4. The audio device of claim 1, the housing comprising a first side that comprises the first support surface and a second side opposite the first side, the second side comprising the second support surface, and the first and second surfaces having asymmetric orientations such that the first and second sides are of asymmetric configuration.

5. The audio device of claim 1, wherein:

the housing has a generally elongate shape defining a first end comprising a third support surface and a second end comprising a fourth support surface, the third and fourth support surfaces having different orientations;

the housing comprises first and second sides that extend lengthwise along the elongate shape; and the control circuit determines whether the first axis is oriented to one of the first angle of elevation, the second angle of elevation, a third angle of elevation associated with physically supporting the audio device by the third support surface and a fourth angle of elevation associated with physically supporting the audio device by the fourth support surface, and alters the characteristic of the acoustic output based on whether the first axis is oriented to one of the first, second, third and fourth angles of elevation.

6. The audio device of claim 1, comprising a second acoustic driver incorporated into the housing to acoustically output sound in a radiating pattern associated with a second axis of the second acoustic driver, wherein:

the first and second axes extend within a plane;

the control circuit determines an orientation of the plane relative to the direction of the force of gravity;

the control circuit allocates one of a first audio channel and a second audio channel to the first acoustic driver and allocates another of the first and second audio channels to the second acoustic driver in response to the plane being oriented more horizontally than vertically with respect to the direction of the force of gravity; and the control circuit to allocate a mixture of the first and second audio channels to at least one of the first and second acoustic drivers in response to the plane being oriented more vertically than horizontally with respect to the direction of the force of gravity.

7. The audio device of claim 6, the housing having a generally elongate shape defining a first end at which the first acoustic driver is disposed and a second end at which the second acoustic driver is disposed, wherein the plane being oriented more horizontally than vertically is associated with the housing being rotated to a landscape orientation and the plane being oriented more vertically than horizontally is associated with the housing being rotated to a portrait orientation.

8. The audio device of claim 6, the control circuit to determine which of the first and second audio channels to allocate to the first acoustic driver and which of the first and second audio channels to allocate to the second acoustic driver based on the direction of the force of gravity relative to the plane when the plane is oriented more horizontally than vertically.

9. The audio device of claim 1, comprising an interface coupled to the control circuit to receive via a communications link a signal representing sound to acoustically output via at least the first acoustic driver.

10. The audio device of claim 9, comprising a manually operable control coupled to the control circuit, the control circuit to monitor the control for an indication of manual operation to convey a command to alter acoustic output of sound by at least the first acoustic driver, and to operate the interface to convey the command to a source device from which the signal representing sound is received via the communications link.

11. An apparatus comprising:

a processor component;

a driver circuit coupled to the processor component to drive a first acoustic driver of an audio device located on a surface to acoustically output sound in a radiating pattern associated with a first axis of the first acoustic driver;

an orientation component for execution by the processor component to monitor an orientation detector to detect a direction of a force of gravity, and determine whether the first axis is oriented to one of a first angle of elevation associated with physically supporting a housing of the audio device incorporating the first acoustic driver by a first support surface thereof and a second angle of elevation associated with physically supporting the housing by a second support surface thereof, wherein the first and second support surfaces have different orientations; and wherein the first angle of elevation and the second angle of elevation are different and non-zero relative to the surface on which the audio device is located and a filter block to alter a characteristic of acoustic output of the sound by the first acoustic driver based on the first axis being oriented to one of the first and second angles of elevation, wherein the orientation component is configured to retrieve from a storage one of a first digital filter configuration and a second digital filter configuration based on the first axis being oriented to one of the first and second angles of elevation, and to configure at least one digital filter of the filter block to alter the characteristic based on the retrieved one of the first and second digital filter configurations, and wherein:

the housing comprises and is separable into a first housing portion and a second housing portion;

the first housing portion comprises the first acoustic driver and the processor component; and the second housing portion comprises the storage and the first and second support surfaces, the orientation component to retrieve one of the first and second digital filter configurations through a connector coupling the first and second housing portions.

12. The apparatus of claim 11, wherein:

the orientation component determines whether the first axis is oriented to one of the first angle of elevation, the second angle of elevation, a third angle of elevation associated with physically supporting the housing by a third support surface thereof and a fourth angle of elevation associated with physically supporting the housing by a fourth support surface thereof, wherein:

the housing has a generally elongate shape defining at least one elongate side comprising at least one of the first and second support surfaces, defining a first end comprising the third support surface, and defining a second end comprising the fourth support surface; and the third and fourth support surfaces have different orientations; and the filter block alters the characteristic of the acoustic output based on whether the first axis is oriented to one of the first, second, third and fourth angles of elevation.

13. The apparatus of claim 11, wherein:

the orientation component determines an orientation of a plane in which both the first axis and a second axis extend relative to the direction of the force of gravity, the second axis associated with a radiating pattern of a second acoustic driver incorporated into the housing; and the apparatus comprises a channel component to allocate one of a first audio channel and a second audio channel of the sound to the first acoustic driver and allocate the other of the first and second audio channels to the second acoustic driver in response to the plane being oriented more horizontally than vertically with respect to the direction of the force of gravity, and to allocate a mixture of the first and second audio channels to at least one of the first and second acoustic drivers in response to the plane being oriented more vertically than horizontally with respect to the direction of the force of gravity.

14. The apparatus of claim 13, the orientation component to determine which of the first and second audio channels to allocate to the first acoustic driver and which of the first and second audio channels to allocate to the second acoustic driver based on the direction of the force of gravity relative to the plane when the plane is oriented more horizontally than vertically relative to the direction of the force of gravity.

15. The apparatus of claim 11, comprising:

an interface to couple the processor component to a communications link; and a communications component for execution by the processor component to operate the interface to receive via the communications link a signal representing sound to acoustically output via at least the first acoustic driver.

16. The apparatus of claim 15, comprising a user interface (UI) component for execution by the processor component to monitor a manually operable control incorporated into the housing for an indication of manual operation to convey a command to alter acoustic output of sound by at least the first acoustic driver, the communications component to operate the interface to transmit the command to a source device from which the signal is received via the communications link.

* * * * *